United States Patent [19]

Fossum

[11] 4,169,442

[45] Oct. 2, 1979

[54] CARBURETOR DE-ICER

[76] Inventor: Gust S. Fossum, 42052 3rd St. East, Lancaster, Calif. 93534

[21] Appl. No.: 812,603

[22] Filed: Jul. 5, 1977

[51] Int. Cl.[2] ..... F02M 31/00

[52] U.S. Cl. ..... 123/122 A; 123/122 E; 261/DIG. 20; 261/144

[58] Field of Search ..... 123/122 A, 122 E, 122 AA; 261/DIG. 20, 144, 145

[56] References Cited

U.S. PATENT DOCUMENTS

| | | | |
|---|---|---|---|
| 1,359,168 | 11/1920 | Guthrie | 123/122 A |
| 1,461,470 | 7/1923 | Ackley | 123/122 E |
| 3,237,926 | 3/1966 | Bickhaus | 261/DIG. 20 |
| 3,916,859 | 11/1975 | Fossum | 123/122 R |
| 3,961,616 | 6/1976 | Brown | 123/122 A |
| 4,048,969 | 9/1977 | Widman | 123/122 E |

FOREIGN PATENT DOCUMENTS

| | | | |
|---|---|---|---|
| 188401 | 12/1936 | Switzerland | 123/122 A |

*Primary Examiner*—Ronald H. Lazarus
*Attorney, Agent, or Firm*—Ralph M. Flygare

[57] ABSTRACT

A carburetor having means for utilizing the pressurized lubricating oil which has been heated by the engine, to heat the idle mixture adjusting needle valve area and the main fuel jet nozzle area. Divided oil passages are provided within the carburetor structure for circulating the heated oil from the engine to the ice-susceptible areas before returning it to the engine's lubricating system for reheating. Flow adjustment means are provided for regulating the flow through the divided passages.

7 Claims, 7 Drawing Figures

FIG. 3
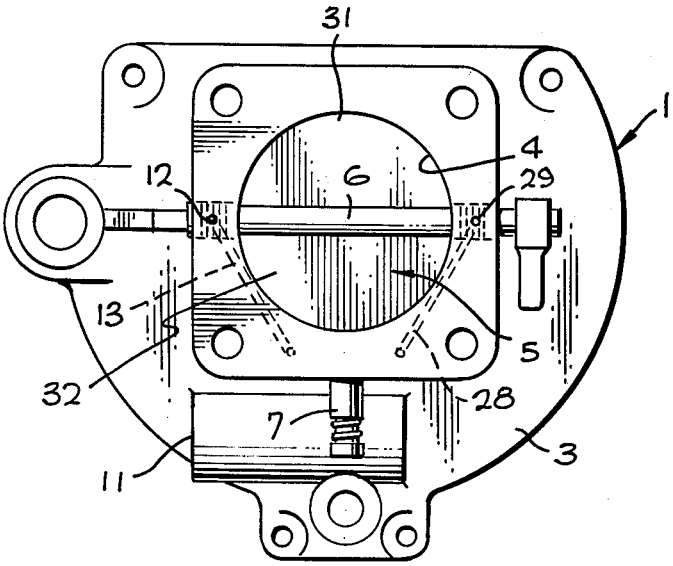
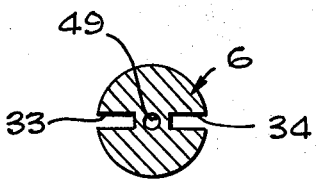
FIG. 7
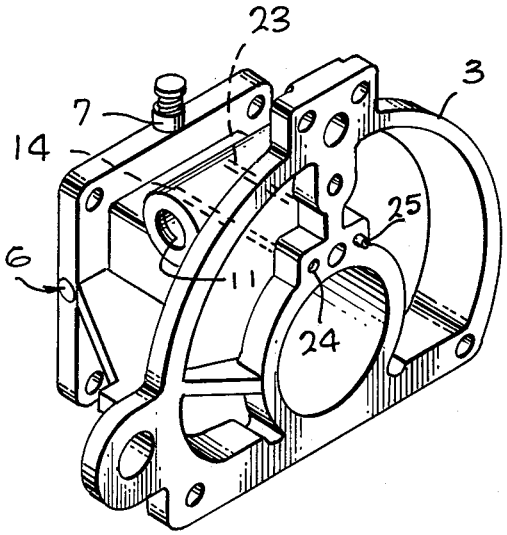
FIG. 5
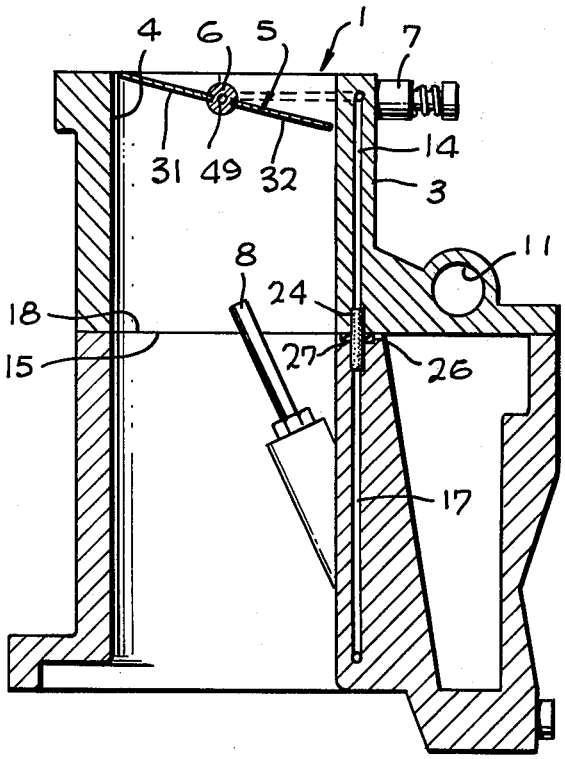
FIG. 4

CARBURETOR DE-ICER

BACKGROUND OF THE INVENTION

Certain climatic conditions, particularly those characterized by cool, humid weather, may cause the formation of icy deposits on the internal portions of a carburetor which have been chilled by the evaporation of the volatile fuel, and entrained water vapor. The formation of ice within the carburetor venturi, on the fuel jets, and on the throttling mechanism, is particularly hazardous in the case of internal combustion aircraft engines. Heretofore it has been a common practice to divert air heated by the engine's cooling or exhaust systems into the carburetor to prevent icing. This has not been altogether satisfactory for a number of well-known reasons, and imposes significant engine performance penalties. Among the drawbacks of heated-air de-icer systems are the undesirable expansion and evaporation of the fuel, and the lowering of the density of the air/fuel mixture.

To overcome these aforementioned shortcomings of heated-air de-icers, various means have been proposed heretofore to provide improved de-icer systems. Typical of these schemes are the use of electrical heating elements, as disclosed in U.S. Pat. No. 3,128,321 to Hammerschmidt, and U.S. Pat. No. 2,941,061 to Bowers. Other means for suppressing carburetor ice formation, or the adverse effects thereof, are based upon novel geometry of the carburetor mechanism such as that disclosed in U.S. Pat. No. 2,693,175 to Hickok et al, and U.S. Pat. No. 3,057,609 to Hegna.

It has been proposed to obviate the undesired effects of directly heating the air portion of the air/fuel mixture entering the carburetor by heating the body structure of the carburetor in the manner disclosed in U.S. Pat. No. 2,719,519. Although this represents an improvement over many of the prior approaches to solving the icing problem, it has its own drawbacks including an adverse effect on engine idling performance. For this reason, the device disclosed in U.S. Pat. No. 3,916,859 was invented by the inventor of the present application, which in turn is an improvement thereof.

While not directed to the problem of carburetor icing, the following U.S. Pat. Nos. are illustrative of prior art, inventions which have as their objective the use of engine heat, conducted via either exhaust air or lubricating oil to assist in the vaporization of fuel entering the carburetor; 1,078,919 to Hall; 3,016,890 to Bibo; 3,150,652 to Hallabaugh; and 3,459,162 to Burwinkle et al.

SUMMARY OF THE INVENTION

The present invention is an improvement over all of the aforementioned prior art devices, particularly insofar as it prevents ice formation within the carburetor without adversely effecting the air/fuel mixture, and further applies heat directly to the most ice-susceptible portion of the carburetor mechanism, namely the venturi butterfly valve, the fuel jet nozzle area, and the needle valve area. The use of the engine's lubricating oil as the medium for heat exchange between the engine and the carburetor results in the added benefit of desirably cooling the engine oil.

It is, therefore, an object of the invention to provide a novel and improved carburetor de-icer utilizing heated engine oil as a heat exchange medium for the transfer of engine heat directly to the valve and jet areas of the carburetor.

Another object of the invention is to provide a novel and improved carburetor de-icer employing plural passage means within the metal structure of a carburetor for conducting engine heat, via an oil heat exchange medium, to the valves and fuel jets thereof.

Yet another object of the invention is to provide a more efficient carburetor de-icer than provided by devices of the prior art intended to accomplish a generally similar function.

Still another object of the invention is to provide a novel and improved carburetor de-icer capable of efficiently applying heat directly to the areas of the carburetor most susceptible of icing.

The invention, both as to its construction and method of operation, together with further objects and advantages, will become apparent upon reference to the following description and the accompanying drawings:

BRIEF DESCRIPTION OF THE DRAWINGS

FIG. 3 is a top plan view of the apparatus in FIG. 1;

FIG. 4 is a cross-sectional view taken along line 4—4 of FIG. 1;

FIG. 5 is a perspective view showing the underside of the upper case member of the apparatus of FIG. 1;

FIG. 7 is a cross-sectional view taken along line 7—7 of FIG. 6.

DESCRIPTION OF THE PREFERRED EMBODIMENT

Figure 1:
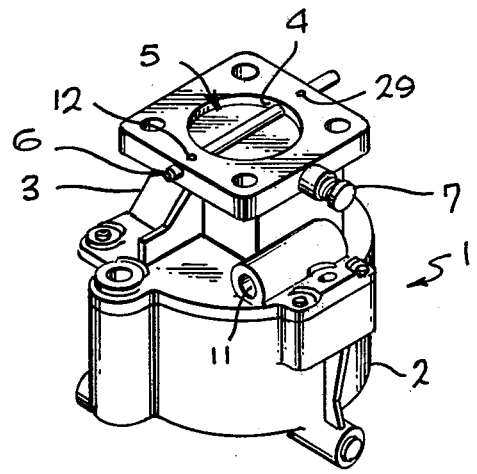
FIG. 1 is a perspective view of a carburetor for an internal combustion engine, and having an integral de-icer constructed in accordance with the invention.

There is shown in FIG. 1 a conventional up-draft carburetor 1 for an internal combustion engine representative of the type suitable for utilization of the de-icer of the present invention. While the carburetor (1) shown is of the single-barrel type, it should be understood that this is by way of example only, since the novel de-icer device of the invention may be incorporated into multiple-barrel carburetors as well. The carburetor 1 comprises a main body 2, adapted to be mounted on the intake manifold (not shown) of an internal combustion engine, and an upper body 3 secured thereto. The intake body 3 has an air intake or throat portion 4, which in combination with a coaxial passage in the main body 2 comprises a venturi tube. The throat portion 4 is provided with a throttle valve 5.

Figure 2:
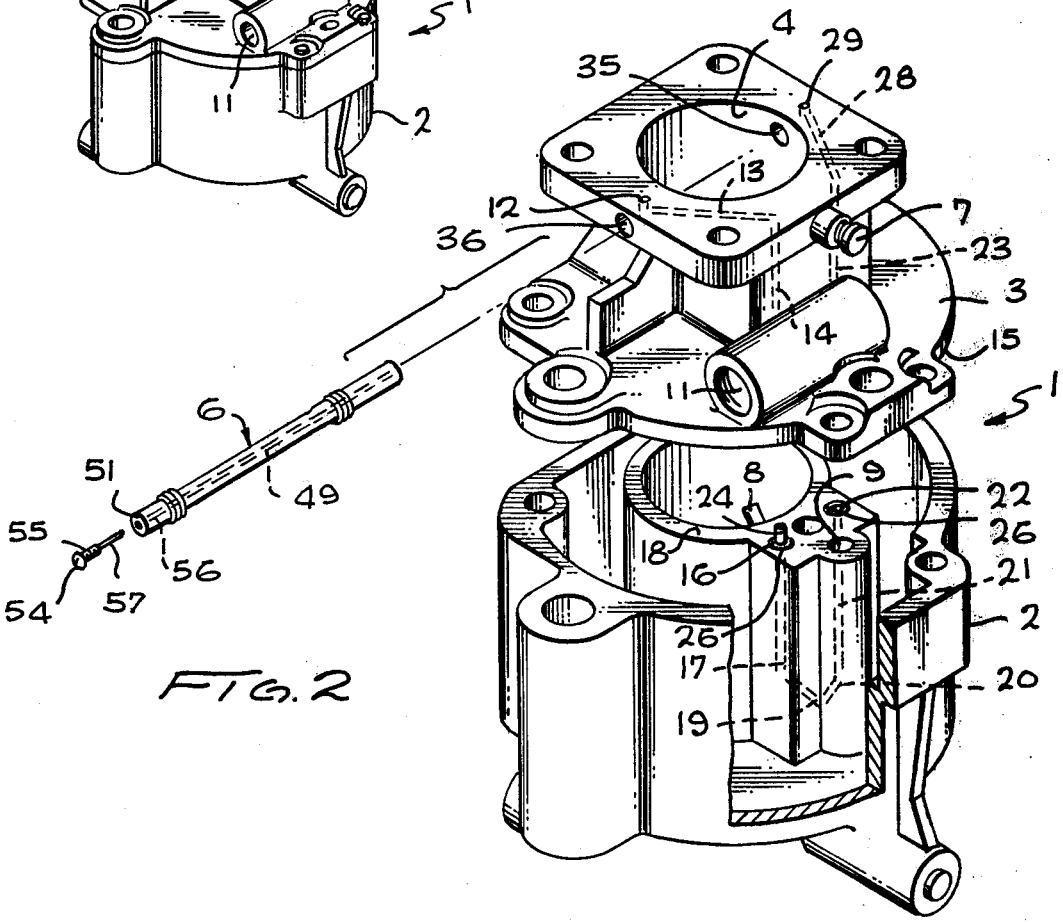
FIG. 2 is an exploded view of the apparatus of FIG. 1.

The throttle valve 5 comprises a circular plate or pair of semi-circular plates, the overall diameter of which conforms to the bore of the venturi tube. The throttle plates are mounted on shaft 6 which is pivotally mounted within and set transversely across the venturi passage (3). The throttle valve 5 and shaft 6 may be rotated by a suitable linkage external to the carburetor, to control the opening of the venturi tube. Fuel is supplied to the venturi tube via idling jet 7 and main metering jet 8, both of which communicate with fuel inlet 11. Fuel passage 9 interconnects main metering jet 8 with inlet 11, as best seen in FIG. 2. When the throttle valve 5 is open, a mixture of air and fuel passes through the venturi tube into the intake manifold of the engine.

A more complete description of the exemplary carburetor, and the operation thereof, may be found in the hereinbefore mentioned U.S. Pat. No. 3,916,859, the foregoing brief description of the basic features of the device being sufficient for one versed in the art to understand the application of the present invention thereto.

As previously noted, due to the absorption of heat by the evaporation of fuel, and the entrainment of water vapor in the intake air supplied to the carburetor, icing frequently occurs to the degree that the venturi tube and the fuel jets are coated with ice deposits and malfunctioning of the carburetor ensues. Experience has shown that ice formation occurs most readily in cool weather with relatively high humidity, typcially in the range of ambient tempertures from about 5° C. to about 15° C. when the relative humidity is above about 60%. The temperature range between 1° C. and 10° C. is particularly conducive to the formation of ice deposits within the carburetor. The optimum fuel temperature is approximately 14° C. If the fuel is cooler, there is a mixing penalty, and if warmer, the air/fuel density is less than optimum. The present invention precludes these difficulties by warming only the critical areas of the carburetor mechanism, namely those otherwise susceptible to icing, without adversely changing either the air or fuel temperature, or the mixture thereof. Thus, optimum density of the mexture may be maintained throughout the range of critical ambient icing conditions.

It is to be understood that the invention is applicable to aircraft, automotive, marine, stationary, and other types of internal combustion engines, it being only required that there be provided a recirculating pressurized oil lubrication system. The oil in the lubricating system is heated by the operation of the engine and comprises the heat transfer medium for the de-icer system. Typically, the engine is provided with an oil reservoir under the crank case and an oil pump for circulating oil from the reservoir to various lubrication points, after which it is returned to the reservoir. Such systems are well-known and it is not deemed necessary herein to described them further. The present invention diverts a portion of the oil on the high pressure side of the oil pump to a series of passageways in the carburetor, as will be described in detail in a subsequent part of this specification, after which it is returned to the main lubricating system of the engine.

Referring again to FIG. 2, the upper body 3 of the carburetor 1 is provided with an oil inlet port 12 through which pressurized and heated oil from the engine's oil pump (not shown) enters the de-icer system. Passage 13 extends horizontally from inlet port 12 to vertical passage 14 which extends through to the bottom surface 15 of upper body 3. The exit port of passage 14 at surface 15 is coaxially aligned with the entrance port 16 of passage 17 at the upper surface 18 of main body 2. Passage 17 is vertically disposed and communicates at its lower end with a first end of sloping passage 19. The second end of sloping passage 19 communicates with the lower end of passage 20, which in turn connects to passage 21. The upper end of passage 21 terminates at the upper surface 18 of main body 2.

The upper end of passage 21 has an exit port 22 which is coaxially aligned with the lower end of passage 23 which is vertically disposed in upper body 3. Entrance port 16 and exit port 22 each may be provided with O-ring seals and coaxial tubular sleeves 24 and 25, respectively, to assure the fluid-tight integrity of the passageway across the planar interface between surfaces 15 and 18. Sleeves 24 and 25, and their respective O-ring seals, may best be seen in FIGS. 4 and 5. The entrance and exit ports 16 and 22 are each provided with a coaxial groove (e.g., grooves 27) adjacent the surface 18 for receiving and retaining their respective O-ring seals. One such seal 26 is shown in FIG. 4 and is of a size suitable to encircle sleeve 24.

The upper end of vertical passage 23 communicates with one end of horizontal passage 28. The other end of passage 28 terminates at outlet port 29, which in turn is to be connected to the return circuit of the engine's oil circulation system for returning oil to the crank-case reservoir.

The function of the passageway system just described is to circulate heated engine oil in proximity to each side of the idle mixture needle valve (7) and its associated idling jet, as well as to each side of the main fuel jet nozzle (8) and the lower-end of the venturi (4). These heated areas are those particularly susceptible to icing conditions. However, by confining the heating to the desired areas, there is an avoidance of undesirable effects of, say, heating the intake air.

In addition to the above-described de-icing system, certain features of the de-icing invention of the previously mentioned U.S. Pat. No. 3,916,859 may be combined in a novel way into an integrated system. The objective of this last-mentioned improvement is to divert a portion of the heated engine oil through passages in the throttle valve assembly to prevent ice formation thereat.

Figure 6:
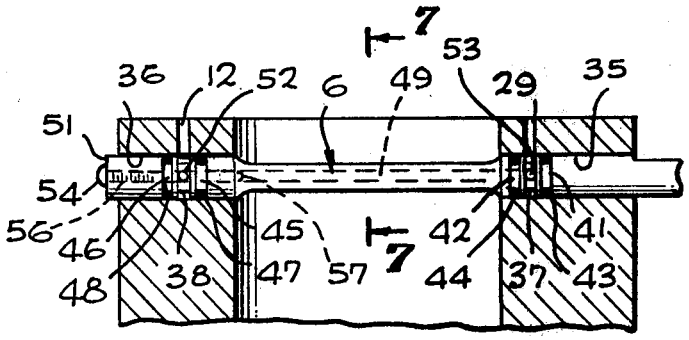
FIG. 6 is a fragmentary cross-sectional view of the throttle valve portion of the invention.

As can best be seen in FIGS. 3, 6 and 7, the throttle valve comprises shaft 6 and semicircular discs 31–32 fixedly mounted along their straight diametral edge within receiving slotted grooves 33–34, respectively. Shaft 6 is rotatably mounted in journals 35–36 in body 3, so as to permit the upper part of the carburetor throat (4) to be selectively choked. Shaft 6 is provided with annual grooves 37–38 which confront their respective journals 35 and 36. Grooves 37 and 38 are aligned with, and in fluid communication with, inlet port 12 and outlet port 29. Annular grooves 41 and 42 are located on either side of groove 37, and are adapted to receive and retain O-ring seals 43 and 44, respectively. A similar construction, comprising grooves 45–46 and O-ring seals 47–48 are disposed adjacent to fluid-communicating groove 38 on the other end of shaft 6. A longitudinal passage 49 is coaxially disposed from end 51 of shaft 6, through to transverse passage 52 communicating with groove 38. Also, transverse passage 53 extends between longitudinal passage 49 and groove 53.

A flow regulator, comprising orifice control member 54, is used to adjust the flow rate through passage 49. Member 54 is provided with a male threaded portion 55 which mates with the female threaded portion 56 of passage 49 to secure member 54 therein. Beyond the threaded portion 55 there is a cylindrical portion 57 of reduced diameter as compared to the internal diameter of longitudinal passage 49. The cylindrical space between these two diameters (49 and 57) effectively comprises a flow-control orifice, the area of which is a function of the overall length of member 54. That is, by selecting the proper diameter of the cylindrical portion of member 54, the area of the orifice may be adjusted. This assembly (49–57) permits the ratio of oil being circulated via passage 13, 14, 17, 19, 21, 23 and 28 with respect to that being circulated through passages 49, 52 and 53, to be selectively regulated. Thus, the overall function is to divide the heated oil between the carburetor body-heating subsystem, and the throttle-valve heating subsystem. Heating of the throttle valve 5 prevents the accumulation of ice thereon, this being another critical area of the carburetor with respect to icing problems.

As will be apparent to those versed in the art, the geometry and arrangement of the components comprising a carburetor will vary in accordance with the requirements of various kinds of internal combustion engines. However, it is the intended function of the invention described herein to apply localized heating to the ice-susceptible areas of the carburetor, such as the choke or throttle valve, the idle jet, and the main fuel jet. The length and path configuration, including any division thereof, and circulation of the oil heat-transfer medium to the aforementioned areas will be determined by the shape and size of the carburetor (1) and will vary somewhat for different installations. It is a feature of the invention, however, that the oil passageways comprising the de-icing system be made integral with the body structure of the carburetor and, where such feature is desired to be included, with the choke-valve shaft.

The foregoing is considered as illustrative only of the principles of the invention. Further, since a number of modifications and adaptations to particular kinds of carburetors will be recognized by those skilled in the art, it is not desired to limit the invention to the exact construction and operation shown and described, and accordingly all suitable modifications and equivalents may be resorted to, falling within the scope of the invention.

What is claimed is:

1. An engine having an oil lubrication system and a carburetor provided with a body having a throat therethrough and a fuel jet communicating with said throat at a point where air and fuel mixing may occur, and an apparatus for preventing carburetor icing comprising:

an entrance port at a first exterior location on said body;

an exit port at a second exterior location on said body, said entrance and exit ports being disposed at spaced apart locations at the top of said body;

means defining a first passage branch within said body extending downwardly from said entrance port to a point at or below the location where said fuel extends into said throat; and, means defining a second passage branch in communication with the end of said first passage branch defining means opposite said entrance port, and extending upwardly therefrom to said exit port, for conducting oil from said engine oil lubricating system therethrough and thereby heat said fuel jet.

2. The apparatus as defined in claim 1, including:

means connected to said entrance port for supplying heated engine oil thereto; and, means connected to said exit port for returning oil therefrom to said engine.

3. The apparatus as defined in claim 2, wherein said carburetor is provided with a valve within said throat, said system including:

hollow shaft means extending transversely across said throat and rotatably supporting said valve;

means for diverting a portion of said engine oil from said entrance port to a first end of said hollow shaft; and, means for conducting oil from the other end of said hollow shaft to said exit port.

4. The apparatus as defined in claim 3, including:

flow regulator means connected to said hollow shaft for selectively adjusting the ratio of the amount of oil entering said first passage branch to the amount of oil entering said one end of said hollow shaft.

5. The apparatus as defined in claim 4, wherein said flow regulator comprises:

an orifice defined by a longitudinal portion of the hollow interior of said shaft; and, an orifice control member coaxially disposed with respect to the interior of said longitudinal portion for regulating the flow of oil in the orifice.

6. The apparatus as defined in claim 1 wherein said body comprises first and second coaxial sections, and wherein said system includes:

first sleeve means disposed within said first passage branch; and, second sleeve means disposed within said second passage branch, said first and second sleeve means serving to maintain fluid-tight integrity between said first and second coaxial sections of said body.

7. The apparatus as defined in claim 1 wherein said carburetor body is further provided with an idle jet, and wherein said passageway defining means is also in proximity with said idle jet for heating thereof.

* * * * *